United States Patent [19]

McFeetors et al.

[11] Patent Number: 4,833,846

[45] Date of Patent: May 30, 1989

[54] GROUND ANCHOR SYSTEM FOR SUPPORTING AN ABOVE GROUND STRUCTURE

[76] Inventors: James McFeetors, 120 Fort St., Winnepeg, Manitoba, Canada, R3C 1C7; James M. Wilson, 504-110 Adamar Rd., Winnipeg, Manitoba, Canada, R3T 3M3

[21] Appl. No.: 153,368

[22] Filed: Feb. 8, 1988

[51] Int. Cl.[4] ..... E04H 12/20

[52] U.S. Cl. ..... 52/154; 52/157

[58] Field of Search ..... 52/154, 152, 153, 155, 52/157, 165, 166

[56] References Cited

U.S. PATENT DOCUMENTS 3,011,597 12/1961 Galloway et al. ..... 52/154

4,471,588 9/1984 Schirm ..... 52/154

*Primary Examiner*—J. Karl Bell

*Attorney, Agent, or Firm*—Adrian D. Battison; Stanley G. Ade; Murray E. Thrift

[57] ABSTRACT

A device for supporting a building structure or the like includes an elongate shaft which is of square cross section and has a short length of screw flight at a lower end and the male screw threaded portion at an upper end extending coaxially with the shaft. A stabilizer in the form of a sleeve arranged to closely surround the square shaft together with three wings to be hammered downwardly into the ground surrounding the shaft after the shaft is screwed into the ground. Various heads can be provided including particularly a building support head in the form of a sleeve with a female screw thread at one end for attachment to the threaded portion of the shaft and a plate separate from the sleeve which can swivel relative to the sleeve to allow adjustment of the height.

15 Claims, 3 Drawing Sheets

GROUND ANCHOR SYSTEM FOR SUPPORTING AN ABOVE GROUND STRUCTURE

BACKGROUND OF THE INVENTION

This invention relates to a ground anchor system for supporting or anchoring an above ground structure particularly of a type which can be simply screwed into the ground and provides a rigid support for an above ground structure either of the type comprising a building frame or a sign or marker arrangement.

At the present time generally light weight structures of this type for example decks, garages, road signs and other markers are mounted upon concrete footings which are formed by excavating a suitable hole to a required depth and pouring concrete to form a rigid foundation upon which the structure can be mounted. The excavation is expensive and time consuming and the pouring of concrete is inconvenient requiring either organizing a suitable delivery or the transportation of ingredients and mixing on site.

Various proposals have been made for attaching above ground structures to an anchor which is screwed into the ground but these have generally not achieved significant commercial success and in many cases have been limited to simply fence posts which carry little load vertically.

It is one object of the present invention, therefore, to provide an improved method of providing a rigid ground engaging support for an above ground structure which can be simply and quickly installed and which can be manufactured from a limited number of simple parts enabling the installation to be relatively inexpensive.

According to the first aspect of the invention, therefore, there is provided a kit of parts for forming a support or anchor for an above ground structure, said kit comprising an elongate shaft, a screw flight rigidly coupled to the shaft at one end of the shaft for rotation therewith, the shaft including at least a portion thereof which is non circular and shaped such that the shaft can be grasped at the portion and rotated to drive the screw flight into the ground, a male screw thread portion on an end of the shaft remote from the flight, said screw thread portion being coaxial and contiguous with the shaft, a stabilizer member separate from the shaft including a sleeve portion shaped to closely surround the shaft for sliding movement therealong, said sleeve portion and said shaft being shaped to prevent rotational movement of the shaft relative to the sleeve portion, at least three wing members rigidly connected to said sleeve portion and extending substantially radially outwardly therefrom at angularly spaced locations therearound, each wing member being shaped such that the stabilizer member can be forced into soil surrounding the shaft, engaging means on said sleeve for engaging said shaft such that said stabilizer member can be held, maintained against longitudinal movement relative to the shaft said male and a head member separate from said shaft and from said stabilizer member including a female screw threaded portion for cooperating with the male screw thread portion on the shaft and means for engaging and supporting said above ground structure.

According to the second aspect of the invention, there is provided a building structure comprising a building frame, and a plurality of ground engaging members each mounted in the ground and arranged to engage an underside of the frame for supporting the frame above the ground, each ground engaging member comprising an elongate shaft, a screw flight rigidly coupled to the lower end of the shaft and screwed into the ground, at least a portion of the shaft being non-circular and shaped such that the shaft can be rotated for screwing movement of the screw flight into the ground, the shaft including a male screw thread portion on an upper end thereof coaxial and contiguous with the shaft, a stabilizer member separate from the shaft including a sleeve portion closely surrounding the shaft and engaged into the ground surrounding the shaft, the stabilizer member including at least three wing members rigidly connected to the sleeve portion and extending substantially radially outwardly therefrom at angularly spaced locations therearound, said sleeve portion being shaped relative to said shaft to prevent rotation of the shaft, and a head member including a female screw threaded portion engaged on said male screw thread portion of the shaft and a plate member rotatable relative to the female screw threaded portion and lying in a horizontal plane for engaging an undersurface of the building frame and providing vertical support therefor.

According to a third aspect of the invention there is provided a method of supporting an above ground structure comprising screwing into the ground a rigid elongate shaft having a screw flight at a lower end thereof by grasping the shaft with a wrench at a portion of the shaft of non-circular cross section, applying to the shaft a stabilizer member separate from the shaft and having a sleeve portion shaped to closely surround the shaft, sliding the stabilizer member longitudinally of the shaft, locating the stabilizer member relative to the shaft to hold said stabilizer member against rotational or longitudinal movement relative to the shaft, applying to a screw thread portion on the shaft a head member including a female screw threaded portion for cooperating therewith applying said above ground structure to said head member.

With the foregoing in view and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
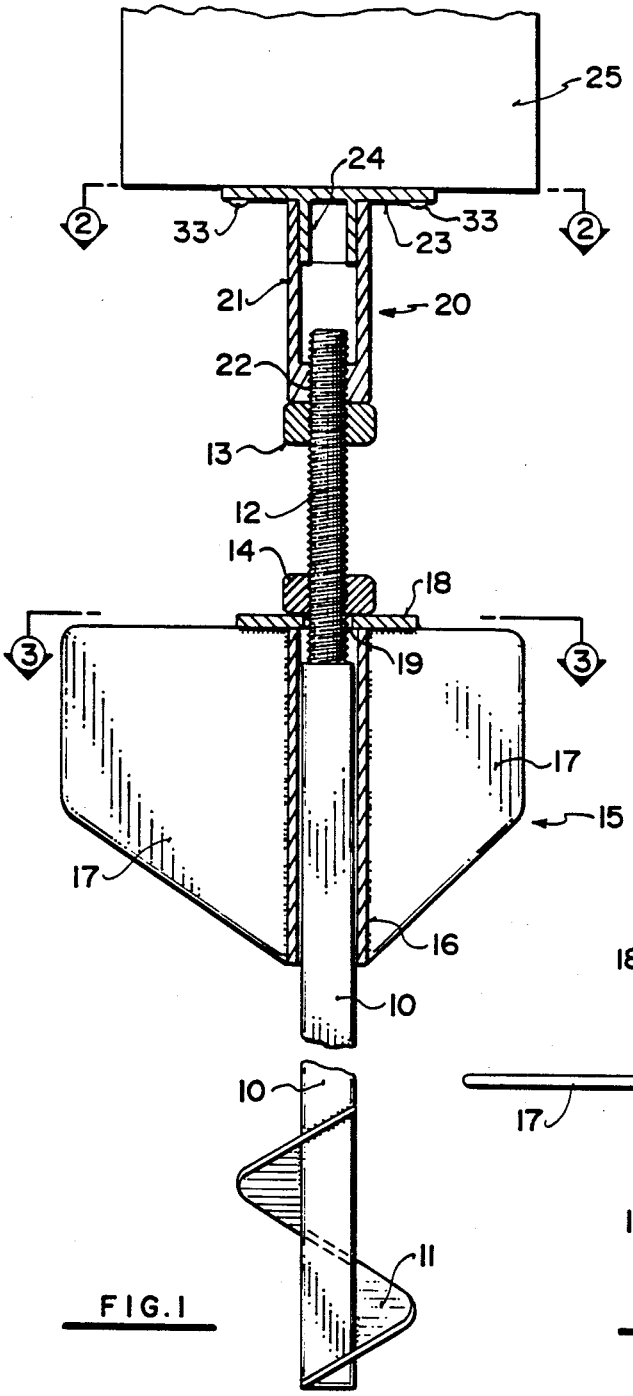
FIG. 1 is a vertical cross sectional view of a ground support system according to the invention.
Figure 2:
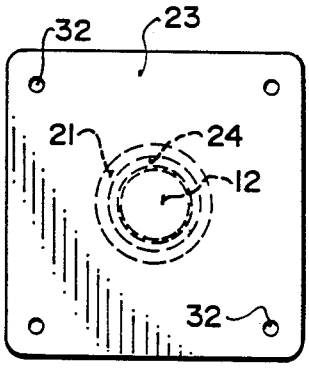
FIG. 2 is a view along the lines 2—2 of FIG. 1.

The apparatus of FIG. 1 comprises a shaft 10 which is formed as an elongate solid rod of continuous square cross section. At a lower end of the shaft is provided a screw flight 11 formed of a sheet metal material welded around the shaft so as to be fixed thereto and rotatable with the shaft. In general only a screw flight of the order of 360° is necessary in order to enable the rotation of the shaft to drive the screw into the ground. The shaft carries at an upper end thereof a screw threaded portion 12 which is coaxial with the remainder of the shaft and is of slightly reduced diameter relative to the square portion of the shaft 10. The screw threaded portion is of circular cross section for cooperation with female screw threaded portions provided by nuts 13 and 14.

Figure 3:
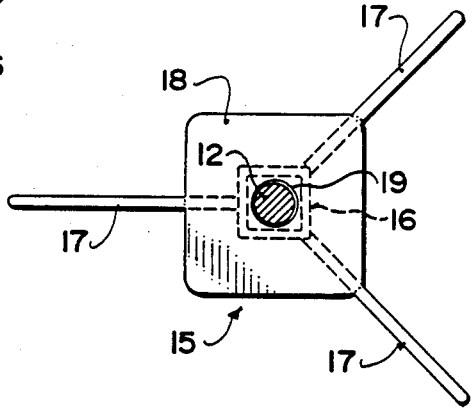
FIG. 3 is a view along the lines 3—3 of FIG. 1.

A second portion of the device comprises a stabilizer member generally indicated at 15 which comprises a sleeve 16 having an internal cross section to closely surround the square cross section of the shaft 10 so that it is a sliding fit upon the shaft 10. The sleeve 16 has a length significantly less than the length of the shaft 10 and has attached to the outer surface thereof three vertical wing members 17 each comprising a flat plate which is welded to the outer surface of the sleeve 16 to project outwardly therefrom in a substantially radial direction. There are provided at least three of the wings 17 and in the arrangement as shown in FIG. 3 the wings are arranged with one extending from a flat surface of the square sleeve and two from opposite corners to arrange the wing members approximately at equal spacing around the sleeve. The wing members are attached to the sleeve by welding.

An upper plate 18 is also attached to the stabilizer, the plate extending outwardly from the shaft to an extent less than the radial dimension of the wing members and being welded to the upper surface of the wing members and possibly also to the top of the sleeve as required for strength. The plate has a central hole 19 which is circular in shape and of a size to closely surround the screw threaded portion 12 of the shaft 10.

A further portion of the equipment comprises a head member generally indicated at 20. The head member 20 includes a sleeve 21 of an internal diameter sufficient to surround the portion 12 of the shaft with a female screw threaded portion 22 at a lower end of the sleeve for cooperation with the threaded portion 12 of the shaft. The head member also includes a separate piece comprising a plate 23 and a stub shaft or projection 24 on the underside thereof which projects into the sleeve 21 as a sliding fit therein to allow rotational movement between the sleeve and the projection.

In installation of the device for supporting a building frame shown schematically at 25, a wrench device 26 is provided which comprises a sleeve 27 formed from the same material as the sleeve 16 so as to closely surround the square shaft 10 together with a cross bar 28 attached to the sleeve for manual actuation. For best convenience of manual operation, the cross-bar is formed by four stub-pipes 28A arranged at 90° spacing together with four separate shaft pieces. Each shaft has an enlarged end so that it can receive an end of a shaft. In this way two pieces can be arranged extending double distance from the stub pipe for increased leverage.

Figure 4:
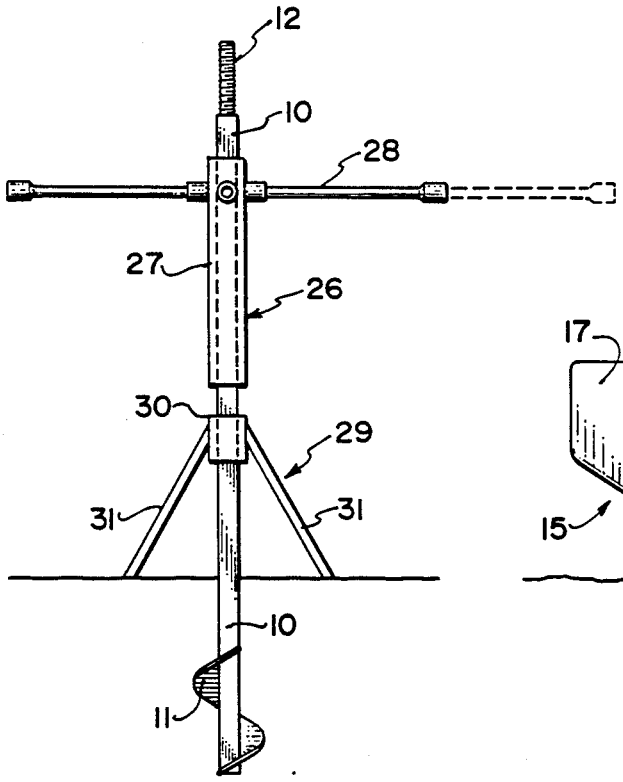
FIG. 4 is a first side elevational view of the apparatus of FIG. 1 in a partially installed position.
Figure 5:
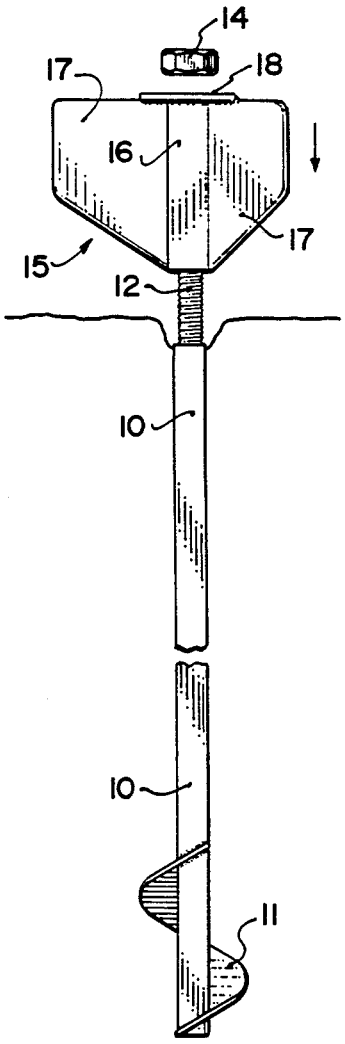
FIG. 5 is a second side elevational view of the apparatus of FIG. 1 in a partially installed position.

The installation is shown in FIGS. 4 and 5 in which the shaft is placed vertically relative to the ground with the screw flight 11 pressed into the ground by the foot of the user. A guide device 29 is then slid onto the shaft so that a sleeve 30 thereof surround the shaft and locates the shaft in a vertical direction. The sleeve is attached to three legs 31 so that initially the sleeve 30 is positioned directly vertical to hold the shaft in the required position as the wrench 26 is also moved into position along the length of the shaft. The operative then applies rotational force to the cross bar 28 to screw the shaft and the flight into the ground. The wrench slides along the shaft so that it can be maintained at a desired height by the operative for the application of force in the most convenient manner.

When the shaft 10 reaches the position shown in FIG. 5, with the screw threaded portion 12 exposed just from the ground, the stabilizer 15 is moved into place initially by placing the lower end of the sleeve 16 over the screw threaded portion 12 and then by applying hammer force against the plate 18 to drive the stabilizer into the ground around the shaft 10. For this purpose the underside of each of the wings 17 is inclined downwardly toward a point at the lower end of the sleeve 16 to improve the driving action of the stabilizer into the ground. When the stabilizer is hammered sufficiently downwardly to expose the upper end of the portion 12, the nut 14 can be applied to the portion 12 and screwed into place to force the plate 18 acting as a washer downwardly to force and hold the stabilizer in a downward position.

Subsequent to the stabilizer fully being located in the ground, the head member can be attached to the upper end of the portion 12 initially by attaching the nut 13 and subsequently by attaching the sleeve 21. It will be appreciated that the height of the head member can be adjusted by rotating the sleeve 21 and moving the lock nut 13 up to the required position to hold the sleeve at a required height.

The plate 23 has a plurality of holes 32 by which the plate can be attached to the underside of the building frame 25 by screws 33. Thus after the plate has been attached to the building structure, further height adjustment can be accomodated by rotation of the sleeve 21 relative to the projection 24 while the plate 23 remains stationary relative to the building structure and relative to the shaft.

The structure as shown can be used for supporting small buildings, decks, walls, and the like and provide the advantages of a durable economical construction which uses the strength of the steel shaft to provide sufficient support while also allowing adjustability, portability and convenience in the construction.

The dimensions of the shaft and of the stabilizer must be chosen in accordance with the weight to be supported and the ground conditions in the area concerned. In particularly heavy duty situations, a second shaft portion can be attached to the first by way of a screw coupling at the lower end of the second shaft portion. In this way the first portion can be driven into the ground and then the second portion attached and continued rotation of the upper or second portion will drive both portions further int the ground to the required depth.

The stabilizer as shown includes the plate 18 as an integral part but in some cases the plate can be provided as a separate item acting as a washer to maintain the stabilizer force downwardly and held against lifting from the ground.

Figure 6:
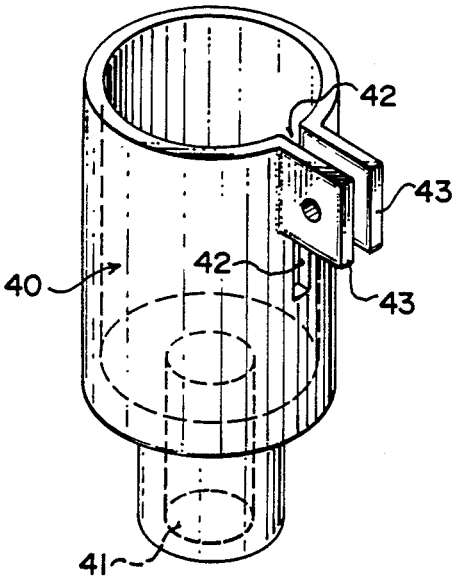
FIG. 6 is an isometric view of a first installation head for use in place of the support head of FIG. 1.
Figure 7:
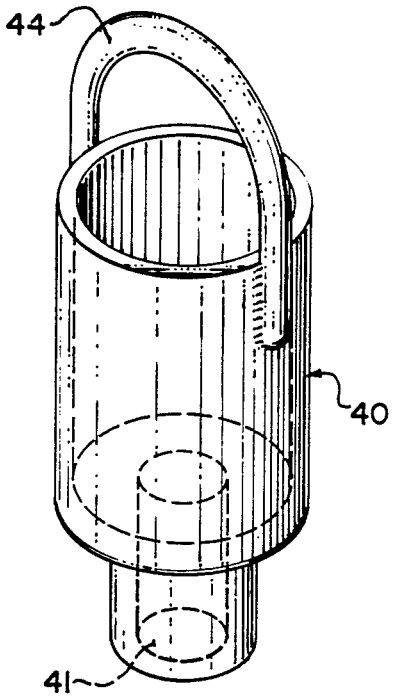
FIG. 7 is an isometric view of a second installation head for use in place of the support head of FIG. 1.

In FIGS. 6 and 7 two alternative head members which can be used respectively for attaching sign posts and for acting as an anchor ring. In both cases the device comprises a sleeve 40 which includes a female screw threaded portion 41 at a lower end. In FIG. 6 the sleeve portion is slotted as at 42 and includes a pair of lugs 43 on either side of the slot so the sleeve can be clamped around the cylindrical post of a road sign or the like. In FIG. 7 a ring 44 is welded onto the upper end of the sleeve 40 to act as an anchor for any tension to be applied by a cable or the like.

Further specific heads can be designed for specific purposes for example survey marker posts.

In place of the washer plate 18, the sleeve 16 can include a screw clamp which can be actuated to grasp the shaft. In this way, the sleeve can be located at a point other than the top of the shaft if convenient in any particular installation.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What is claimed:

1. A kit of parts for forming a support or anchor for an above ground structure, said kit comprising an elongate shaft, a screw flight rigidly coupled to the shaft at on end of the shaft for rotation therewith, a male screw thread portion on an end of the shaft remote from the flight, said screw thread portion being coaxial and contiguous with the shaft, a stabilizer member separate from the shaft including a sleeve portion shaped to closely surround the shaft for sliding movement therealong, the shaft having an outer periphery extending from the screw flight to the male screw thread portion which is of constant polygonal cross-section free from obstruction to longitudinal movement of the sleeve portion therealong and arranged to cooperate with an inner shape of the sleeve portion to prevent rotational movement of the shaft relative to the sleeve portion, at least three wing members rigidly connected to said sleeve portion and extending substantially radially outwardly therefrom at angularly spaced location therearound, each wing member being shaped such that the stabilizer member can be forced vertically into soil surrounding the shaft, nut means for engaging said male screwthreaded portion such that said stabilizer member can be held against longitudinal movement relative to the shaft, a head member separate from said shaft and from said stabilizer member including a female screw threaded portion for cooperating with the male screw thread portion on the shaft and means for engaging and supporting said above ground structure, and a wrench including an elongate sleeve member for engaging over and sliding longitudinally relative to the shaft and having an inner surface for cooperating with said polygonal cross-section for drivingly rotating the shaft.

2. The invention according to claim 1 wherein each wing member is constituted by a single planar plate welded to said sleeve portion and extending outwardly therefrom.

3. The invention according to claim 1 wherein said engaging means comprises a flat plate attached to said stabilizer member and extending outwardly from said sleeve portion thereof to engage over upper edges of said wing members.

4. The invention according to claim 1 wherein the shaft comprises a solid rod of polygonal cross section, said polygonal cross section providing said at least portion thereof for engagement by a cooperating shaped portion of said sleeve portion of said stabilizing member.

5. The invention according to claim 1 wherein the head member comprises a collar portion having said female screw threaded portion at one end thereof such that the collar portion surrounds the male screw thread portion of the shaft when said female screw thread portion is applied thereto.

6. The invention according to claim 1 wherein said means for engaging and supporting said above ground structure comprises a plate for engaging and supporting an underside of a building frame and means for allowing rotation between said plate and said female screw threaded portion so that a height of the plate can be adjusted by rotating the female screw threaded portion relative to the male screw threaded portion while maintaining said plate stationary relative to said building frame and to said shaft.

7. The invention according to claim 6 wherein said female screw threaded portion includes a collar member for surrounding the male screw thread portion of the shaft, said plate member including a projection on an underside thereof arranged to engage said collar member such that a plate member can rotate against an upper edge surface of the collar member.

8. A building structure comprising a building frame, and a plurality of ground engaging members each mounted in the ground and arranged to engage an underside of the frame for supporting the frame above the ground, each ground engaging member comprising an elongate shaft, a screw flight rigidly coupled to the lower end of the shaft and screwed into the ground, the shaft including a male screw thread portion on an upper end thereof coaxial and contiguous with the shaft, a stabilizer member separate from the shaft including a sleeve portion closely surrounding the shaft and engaged into the ground surrounding the shaft, the stabilizer member including at least three wing members rigidly connected to the sleeve portion and extending substantially radially outwardly therefrom at angularly spaced location therearound, the shaft having an outer periphery extending from the screw flight to the male screw thread portion which is of constant polygonal cross-section free form obstruction to longitudinal movement of the sleeve portion therealong and arranged to cooperate with an inner shape of the sleeve portion to prevent rotation of the shaft, and a head member including a female screw threaded portion engaged on said male screw thread portion of the shaft and a plate member rotatable relative to the female screw threaded portion and lying in a horizontal plane for engaging an undersurface of the building frame and providing vertical support therefor.

9. The invention according to claim 8 wherein each wing member is constituted by a single planar plate welded to said sleeve portion and extending outwardly therefrom.

10. The invention according to claim 8 wherein the stabilizer member includes engaging means for engaging said shaft and holding said stabilizer member at a fixed longitudinal position relative thereto.

11. The invention according to claim 10 wherein the engaging means comprises a flat plate attached to said stabilizer member and extending outwardly from said sleeve portion thereof to engage over upper edges of said wing members.

12. The invention according to claim 8 wherein the shaft comprises a solid rod of polygonal cross section, said polygonal cross section providing said at least portion thereof for engagement by a wrench.

13. The invention according to claim 8 wherein the head member comprises a collar portion having said female screw threaded portion at one end thereof such that the colour portion surrounds the male screw thread portion of the shaft when said female screw thread portion is applied thereto.

14. The invention according to claim 8 wherein said means for engaging and supporting said above ground structure comprises a plate for engaging and supporting an underside of a building frame and means for allowing rotation between said plate and said female screw threaded portion so that a height of the plate can be adjusted by rotating the female screw threaded portion relative to the male screw threaded portion while maintaining said plate stationary relative to said building frame and to said shaft.

15. The invention according to claim 14 wherein said female screw threaded portion includes a collar member for surrounding the male screw thread portion of the shaft, said plate member including a projection on an underside thereof arranged to sit inside said collar member such that a plate member can rotate against an upper edge surface of the collar member.

* * * * *